US005893239A

United States Patent [19]

Leahy

[11] Patent Number: 5,893,239

[45] Date of Patent: Apr. 13, 1999

[54] GUTTER SYSTEM WITH GUTTER TILT ACTUATOR

[76] Inventor: Kevin N. Leahy, 280 Kerrwood Dr., Wayne, Pa. 19087

[21] Appl. No.: 08/881,214

[22] Filed: Jun. 24, 1997

[51] Int. Cl.[6] ..... E04D 13/00

[52] U.S. Cl. ..... 52/11; 52/16; 248/48.2

[58] Field of Search ..... 52/11, 15, 16, 52/12; 248/48.1, 48.2

[56] References Cited

U.S. PATENT DOCUMENTS

| | | | |
|---|---|---|---|
| 3,077,055 | 2/1963 | Tripp, Jr. . | |
| 4,117,635 | 10/1978 | Nelson . | |
| 4,309,792 | 1/1982 | Faye | 52/11 X |
| 4,411,108 | 10/1983 | Kerester . | |
| 4,696,131 | 9/1987 | Schreffler . | |
| 4,745,657 | 5/1988 | Faye | 52/11 X |
| 4,807,406 | 2/1989 | Densmore . | |
| 5,335,460 | 8/1994 | Smith, Jr. . | |
| 5,357,719 | 10/1994 | Lewis . | |
| 5,417,015 | 5/1995 | Coyne . | |
| 5,526,611 | 6/1996 | Leahy . | |
| 5,548,931 | 8/1996 | Bryant | 52/16 X |
| 5,649,681 | 7/1997 | Faye | 248/48.2 X |

FOREIGN PATENT DOCUMENTS

| | | | |
|---|---|---|---|
| 2104119 | 3/1983 | United Kingdom | 52/11 |

*Primary Examiner*—Carl D. Friedman
*Assistant Examiner*—Timothy B. Kang
*Attorney, Agent, or Firm*—Paul F. Daebeler

[57] ABSTRACT

The present invention relates generally to a gutter tilt actuator for a rain gutter system for a house, building, structure, etc., which facilitates cleaning of a gutter, and more particularly to a gutter tilt actuator, which is utilized to rotate the gutter from a water collecting position to a cleaning position and from a cleaning position to a water collecting position.

20 Claims, 7 Drawing Sheets

GUTTER SYSTEM WITH GUTTER TILT ACTUATOR

BACKGROUND OF THE INVENTION

1. Field of the Invention

The present invention relates generally to a rain gutter system for a house, building, or other structure, which facilitates cleaning of the gutters, and more particularly to a gutter system having an actuator which is utilized to rotate the gutter from a collecting position to a cleaning position and from a cleaning position to a collecting position.

2. Description of the Prior Art

Gutters are employed to catch water run off from roofs of building structures, particularly roofs of houses, to prevent erosion of the soil adjacent to the structure and to prevent damage to the foundation of the structure. However, the accumulation of debris, such as leaves, often clogs the gutter, and the water, which normally flows through the gutter, overflows down the side of the structure causing damage. Further, weather conditions often pile up ice and snow in the gutter so that water run-off is impeded resulting in leakage through the roof to the interior, and gradual rotting of the roof material and inner structure. In addition, the weight of the ice often damages the gutter itself, and seriously weakens its attachment to the structure.

Removal of accumulated debris restores proper drainage and protects the roof and structure. Although cleaning of the gutter may be accomplished manually by an individual on a ladder, this may be dangerous, particularly to an inexperienced homeowner.

In the prior art, there are rotatable gutter systems. However, these prior art gutter systems involve the use of complex mechanical devices such as pulleys, rods, gears, hand cranks, electric motors, etc. These complex electrical/mechanical prior art gutter systems are difficult to maintain, difficult to install and prohibitively expensive. In addition, the prior art gutter systems are exposed to natural elements causing failure thereof.

Many of these problems were solved by the invention disclosed in U.S. Pat. No. 5,526,611. This invention teaches the use of a gutter tilt actuator affixed to the gutter. A pole or cable is used to rotate the gutter via the gutter tilt actuator from a water collecting position to a cleaning position and from a cleaning position to a water collecting position. Therefore, the high maintenance, complex mechanical devices such as pulleys, rods, gears, hand cranks, electric motors, etc. were not required to rotate the gutter. However, the weather resistant materials (e.g. PVC) used in U.S. Pat. No. 5,526,611 expand and contract as the temperature changes. This places pressure on the slotted supports, and eventually the gutter tilt actuator embedded in the gutter may tear away from the gutter or the support may become dislodged.

SUMMARY OF THE INVENTION

A gutter system is provided which includes at least one gutter and at least one associated gutter tilt actuator for each gutter. Each gutter is configured as an open channel having a bottom and sides. Each side terminates in an upper edge which defines the opening to the channel there between. The bottom and sides have an exterior surface which preferably has a substantially uniformly shaped cross section in the longitudinal direction. A gutter tilt actuator displaces the gutter between a collecting position and a cleaning position. The gutter tilt actuator has a gutter tilt actuator lever and a gutter engaging portion configured to selectively grip the gutter. The gutter engaging portion preferably encircles the gutter complementing the shape of the exterior surface of the gutter and also spans the gutter channel. The gutter engaging portion grips the gutter for rotating the gutter between a collecting position and a cleaning position. However, the gutter engaging portion permits longitudinal displacement with respect to the gutter.

At least one gutter mounting bracket is provided to receive the gutter. The gutter mounting bracket includes a structure attaching portion for attachment to a building and a cantilevered support projecting from the structure attaching portion for supporting the gutter. The cantilevered support is configured to complement the gutter tilt actuator for rotational displacement and preferably includes a slot through which the gutter tilt actuator lever projects wherein the slot defines the limits of rotational displacement of the gutter tilt actuator and, accordingly, the gutter. The slot maintains the longitudinal position of the gutter tilt actuator within the mounting bracket which is affixed to the building structure. Since the gutter tilt actuator is not affixed to the gutter, the gutter may freely expand and contract longitudinally as the temperature changes without damaging the gutter tilt actuator or mounting bracket.

An operator rotates the gutter preferably utilizing a pole with a hook which grasps the gutter tilt actuator lever. Applying a downward force on the gutter tilt actuator lever using the pole, the gutter is rotated from the normal collecting position to the cleaning position. After cleaning, the gutter is rotated from the cleaning position to the collecting position. The gutter tilt actuator may be locked in a collecting position or a cleaning position by rotating the gutter tilt actuator into a securing slot.

In one embodiment, one of the edges of the gutter is configured with a projecting lip for directing water into the open channel of the gutter and inhibiting the collection of debris between the gutter and the structure on which the gutter is mounted. The gutter engaging portion of the gutter tilt actuator preferably has a lip receiving portion for receiving the projecting lip. The projecting lip is preferably beveled proximate the mounting area of the gutter so that the gutter tilt actuator can be received about the gutter without creating a gap between the projecting lip and the structure.

It is an object of the present invention to provide a novel gutter system with an improved gutter tilt actuator.

Another object for the present invention is to provide a gutter tilt actuator for a gutter system, which is simple and economically manufactured, easy to install, easy to maintain and easy to operate.

The above-mentioned and other objects and features of the present invention will become more apparent from the following description when read in conjunction with the accompanying drawings, in which like referenced characters designate the same or similar parts throughout the figures thereof. However, the drawings and descriptions are merely illustrative in nature and not restrictive.

DESCRIPTION OF THE PREFERRED EMBODIMENTS

Figure 1:
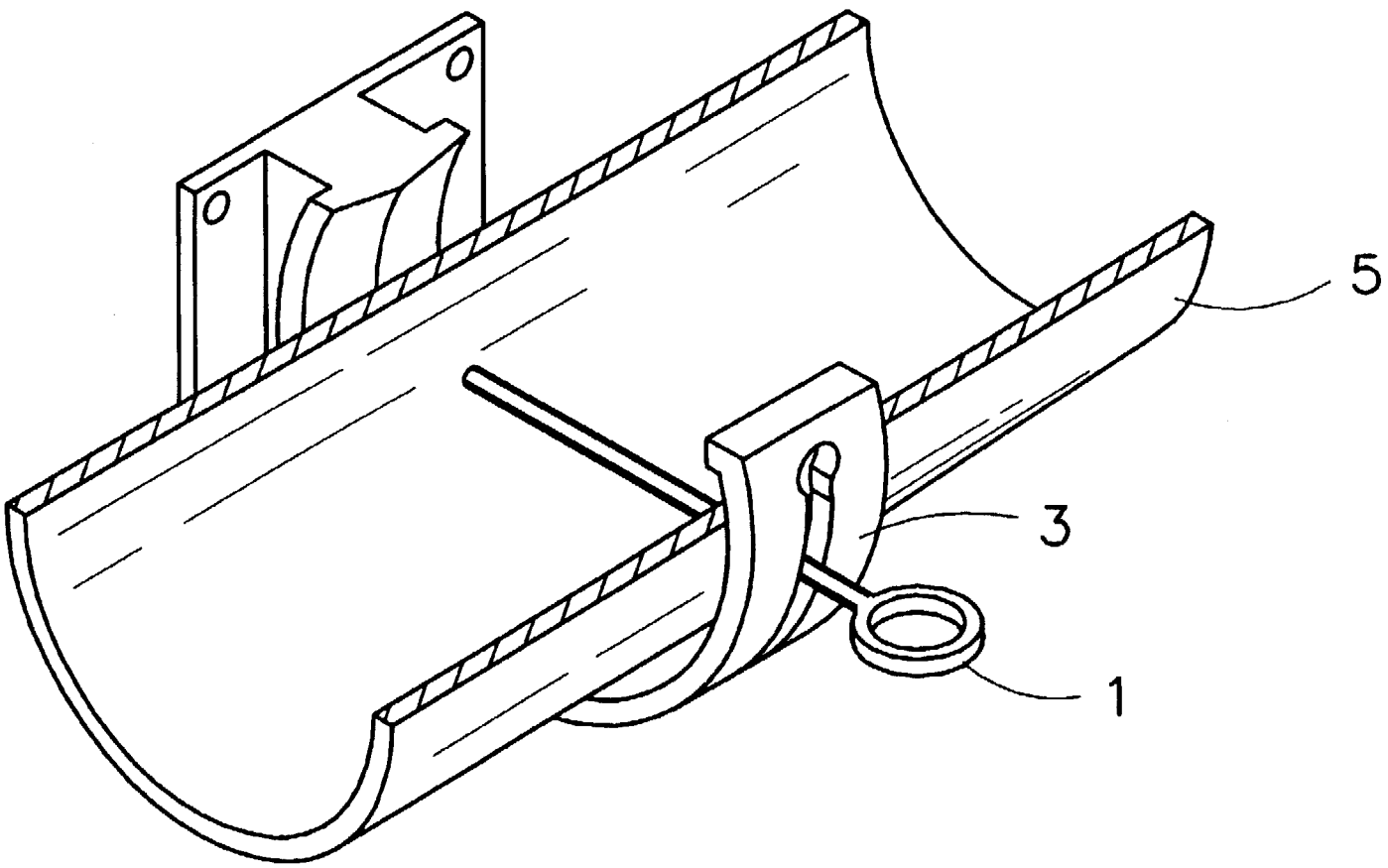
Fig. 1 PRIOR ART
FIG. 1 is a perspective view of a prior art gutter, gutter tilt actuator and mounting bracket.

FIG. 1 shows a prior gutter system as disclosed in U.S. Pat. No. 5,526,611. The gutter system includes a gutter tilt actuator in a slot of a mounting bracket 3 and affixed to a gutter 5. This arrangement inhibits the longitudinal displacement of the gutter 5, which expands and contracts as the temperature changes. The gutter tilt actuator 1 may eventually tear away from the gutter 5 or the mounting bracket 3 may become dislodged.

Figure 2:
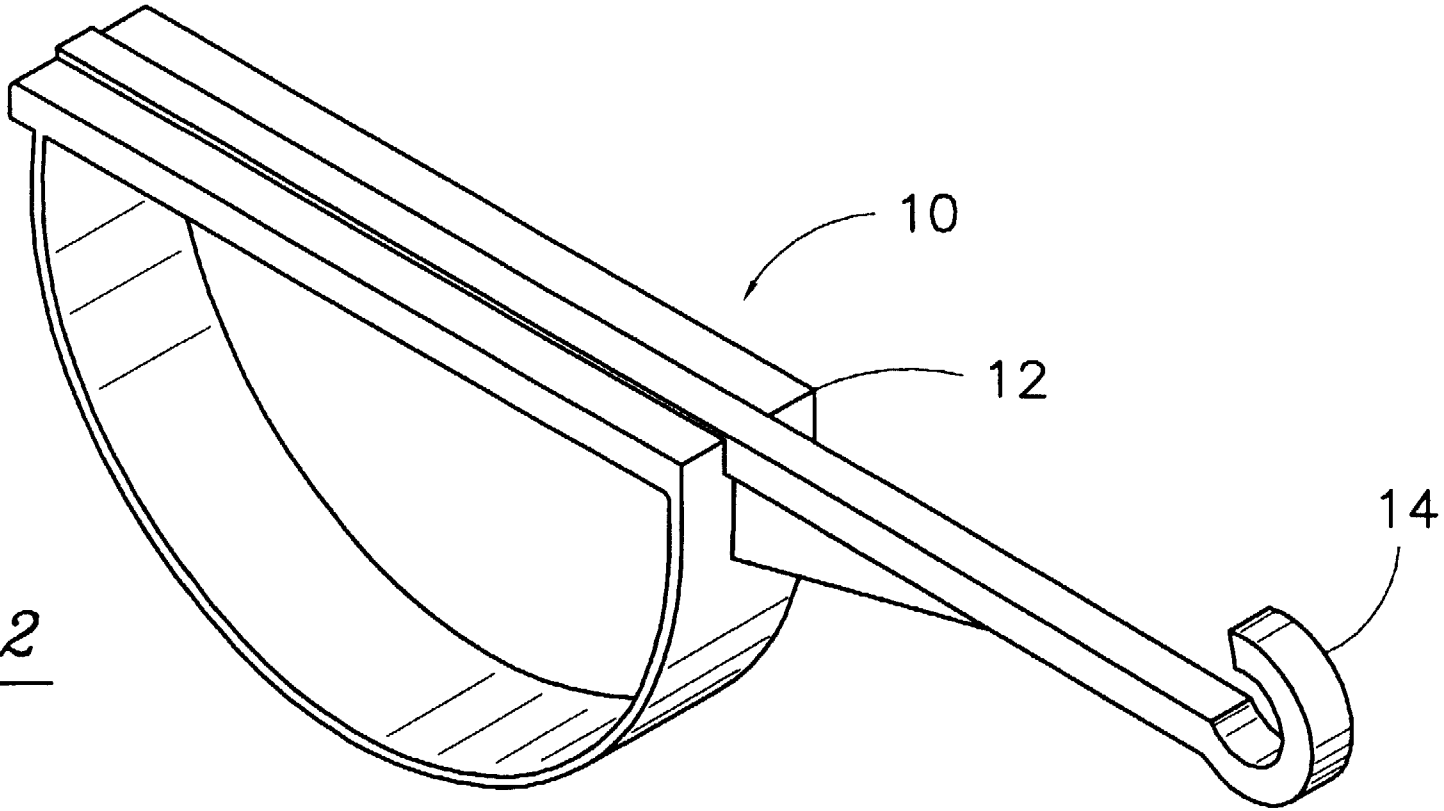
FIG. 2 is a perspective view of a gutter tilt actuator made in accordance with a first embodiment of the present invention.
Figure 3:
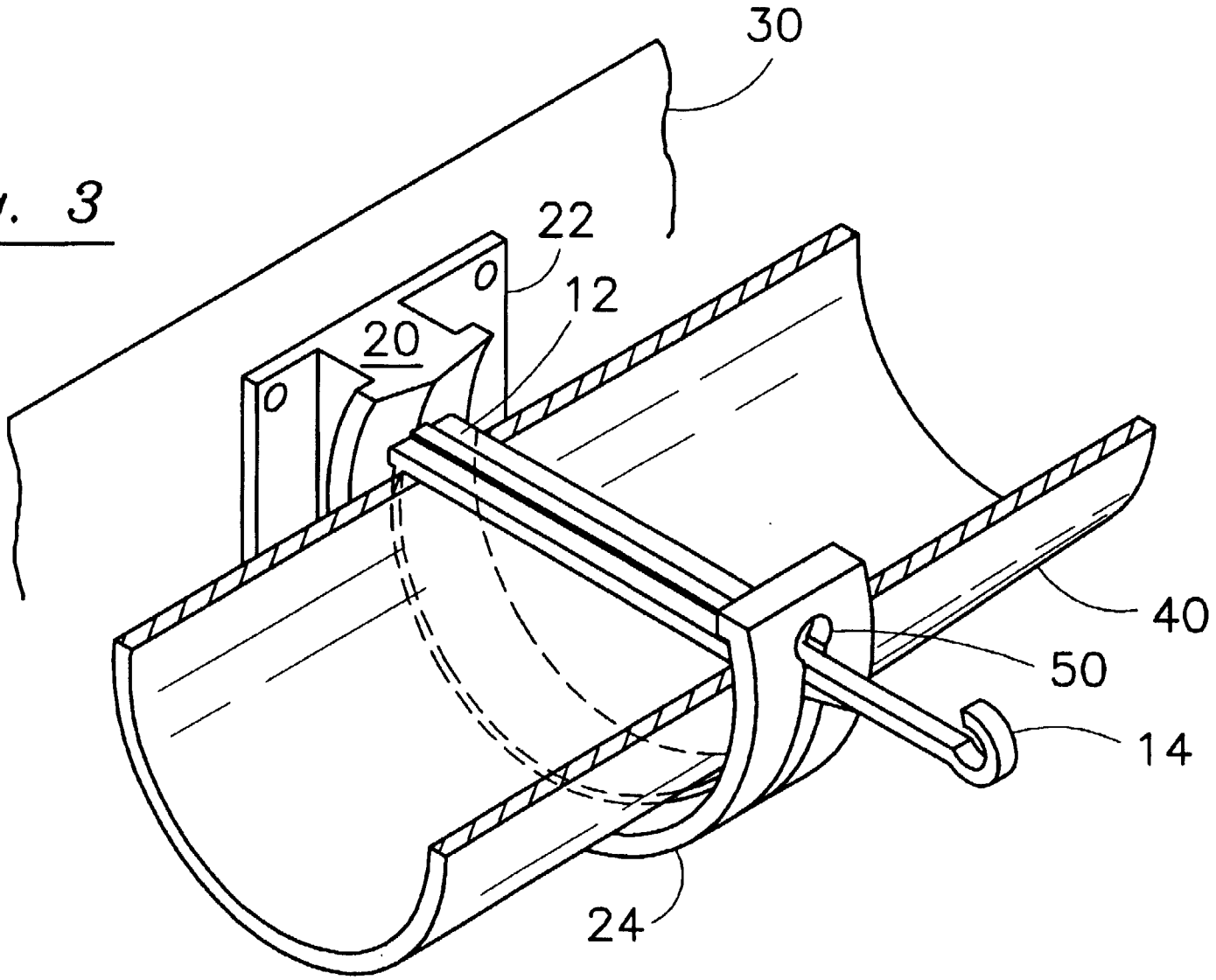
FIG. 3 is a perspective view of the gutter tilt actuator of the first embodiment of the present invention in a mounting bracket, wherein the gutter is in the water collecting position.

FIG. 2 is a perspective view of a first embodiment of a gutter tilt actuator 10. The gutter tilt actuator 10 includes a gutter engaging portion 12 and a gutter tilt actuator lever 14, which projects from the gutter engaging portion 12. FIG. 3 is a perspective view of the gutter tilt actuator 10 in the mounting bracket 20, which is preferably attached under a roof ledge of a structure 30 using anchors, nails, screws, etc. (not shown). The mounting bracket 20 receives a gutter 40 having an open channel between the edges. The mounting bracket 20 includes a structure attaching portion 22 and a cantilevered support 24. Preferably the gutter tilt actuator 10 encircles the gutter 40 and is slid along the outside of the gutter 40. Then, the gutter tilt actuator lever 14 is inserted in the slot of the cantilevered support 24. The gutter engaging portion 12 selectively grips the gutter 40 for rotational displacement. The gutter tilt actuator 10 may also be first placed in the mounting bracket 20 and the gutter 40 slides through the gutter engaging portion 12 of the gutter tilt actuator 10.

The gutter tilt actuator 10, mounting bracket 20 and gutter 40 are preferably manufactured from PVC plastic or any other weather resistant material. Further, it is preferable that a gutter tilt actuator 10 and a mounting bracket 20 be installed for approximately every ten feet of gutter 40.

Figure 4:
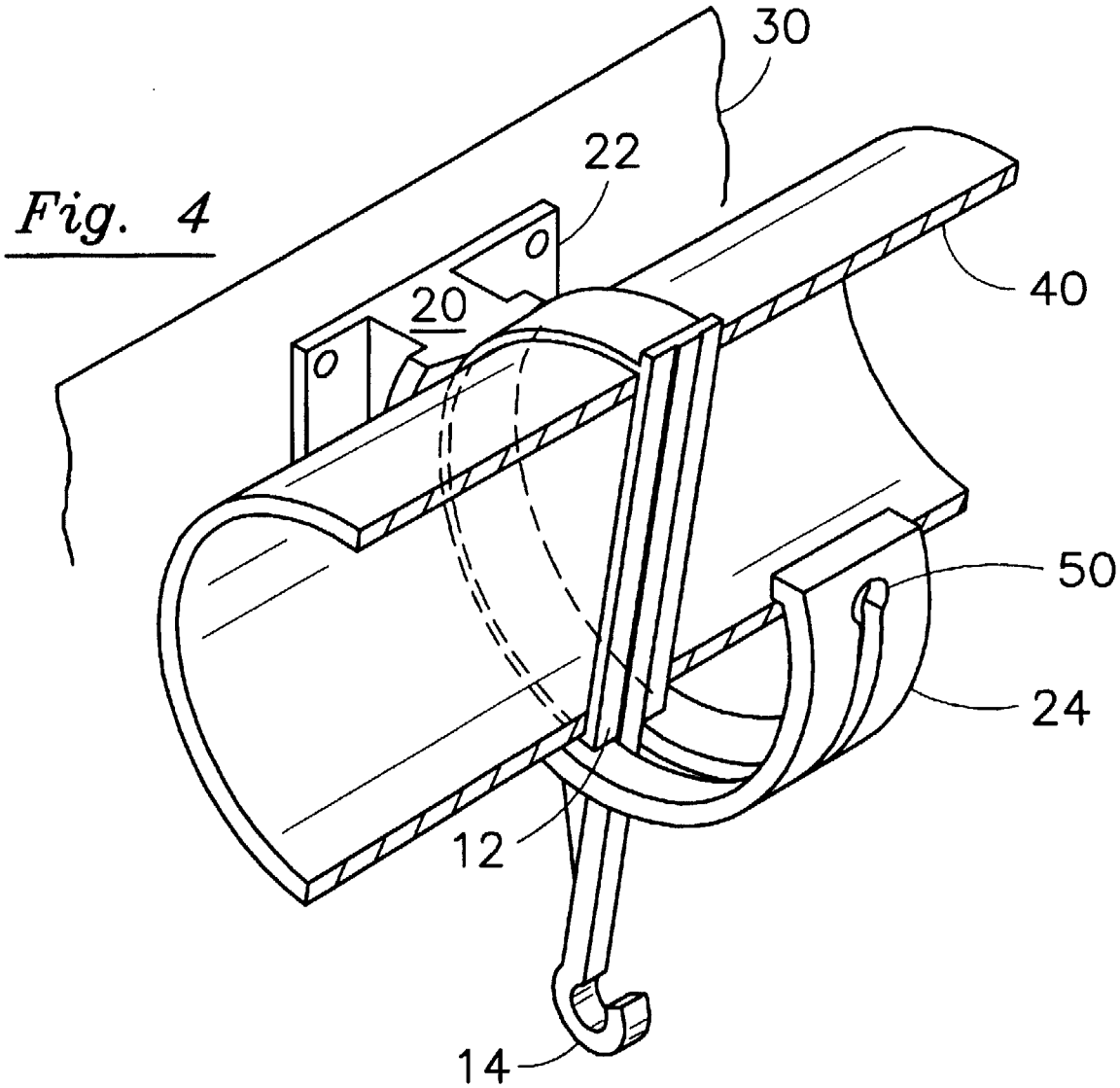
FIG. 4 is a perspective view of the gutter tilt actuator of the first embodiment of the present invention in the mounting bracket, wherein the gutter is in the cleaning position.

An operator standing on the ground connects a hook (not shown) to the gutter tilt actuator lever 14 of the gutter tilt actuator 10. Normally, the gutter 40 is in a first position or collecting position (FIG. 3). When the operator wishes to clean the gutter 40, the operator standing on the ground connects the hook (not shown) to gutter tilt actuator lever 14 of the gutter tilt actuator 10, and rotates the gutter 40 to the second position or cleaning position (FIG. 4). After the gutter 40 is cleaned, the operator uses the hook to rotate the gutter 40 into the water collecting position and preferably locks the gutter tilt actuator lever 14 of the gutter tilt actuator 10 in a securing slot 50 of the cantilevered support 24. Although the gutter tilt actuator lever 14 of the gutter tilt actuator 10 is locked and therefore prevents the gutter 40 from rotating, the gutter 40 freely expands and contracts in a longitudinal direction as temperature changes. There may be a second securing slot (not shown) in the cantilevered support 24 so that the gutter tilt actuator lever 14 of the gutter tilt actuator 10 may be locked into the cleaning position.

Figure 5:
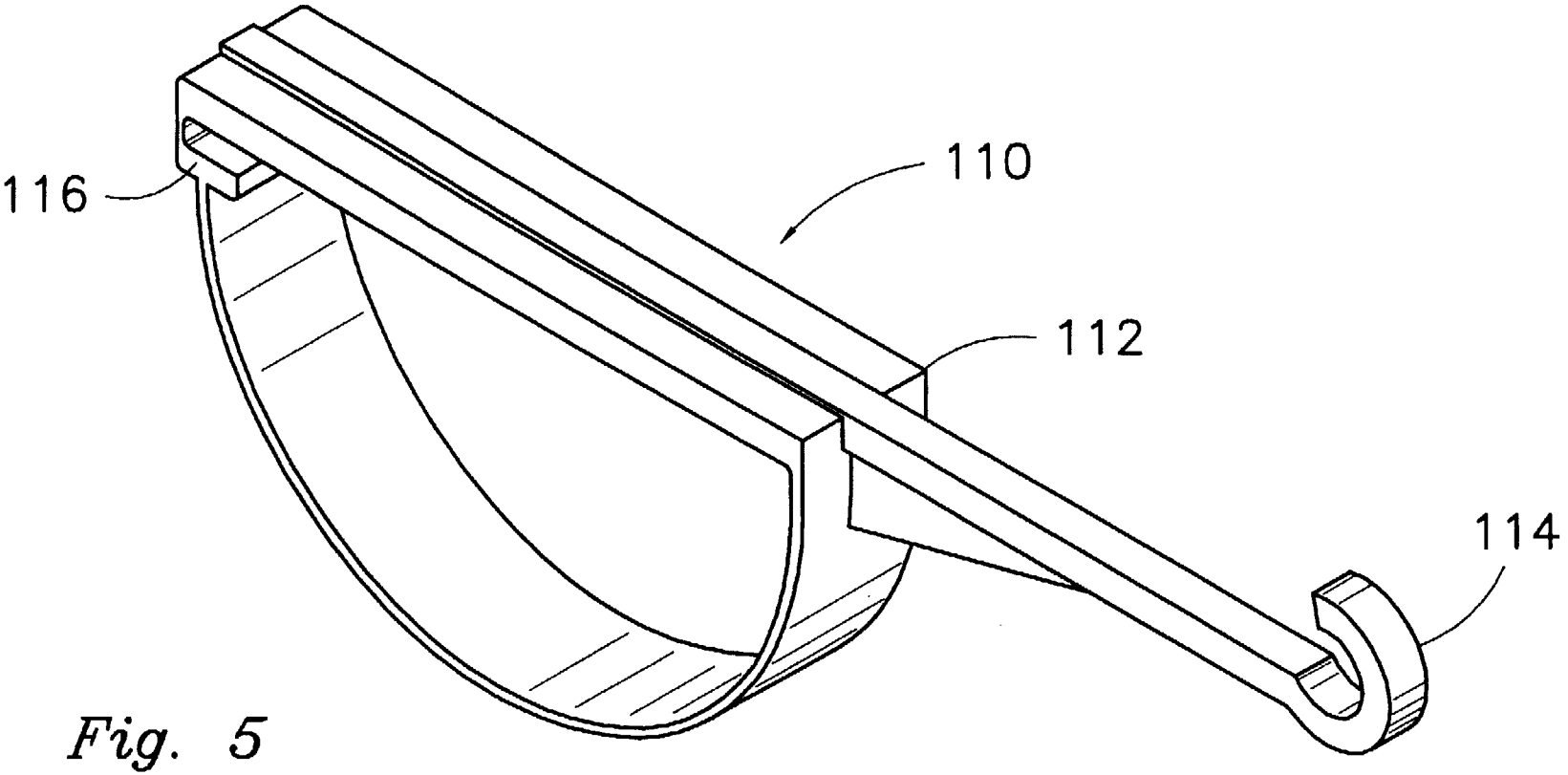
FIG. 5 is a perspective view of the second embodiment of the gutter tilt actuator.

FIG. 5 shows a second embodiment of the gutter tilt actuator 110 of the present invention. The gutter tilt actuator 110 includes a gutter engaging portion 112 and a gutter tilt actuator lever 114 which projects from the gutter engaging portion 112. The gutter engaging portion 112 includes a lip receiving portion 116.

Figure 6:
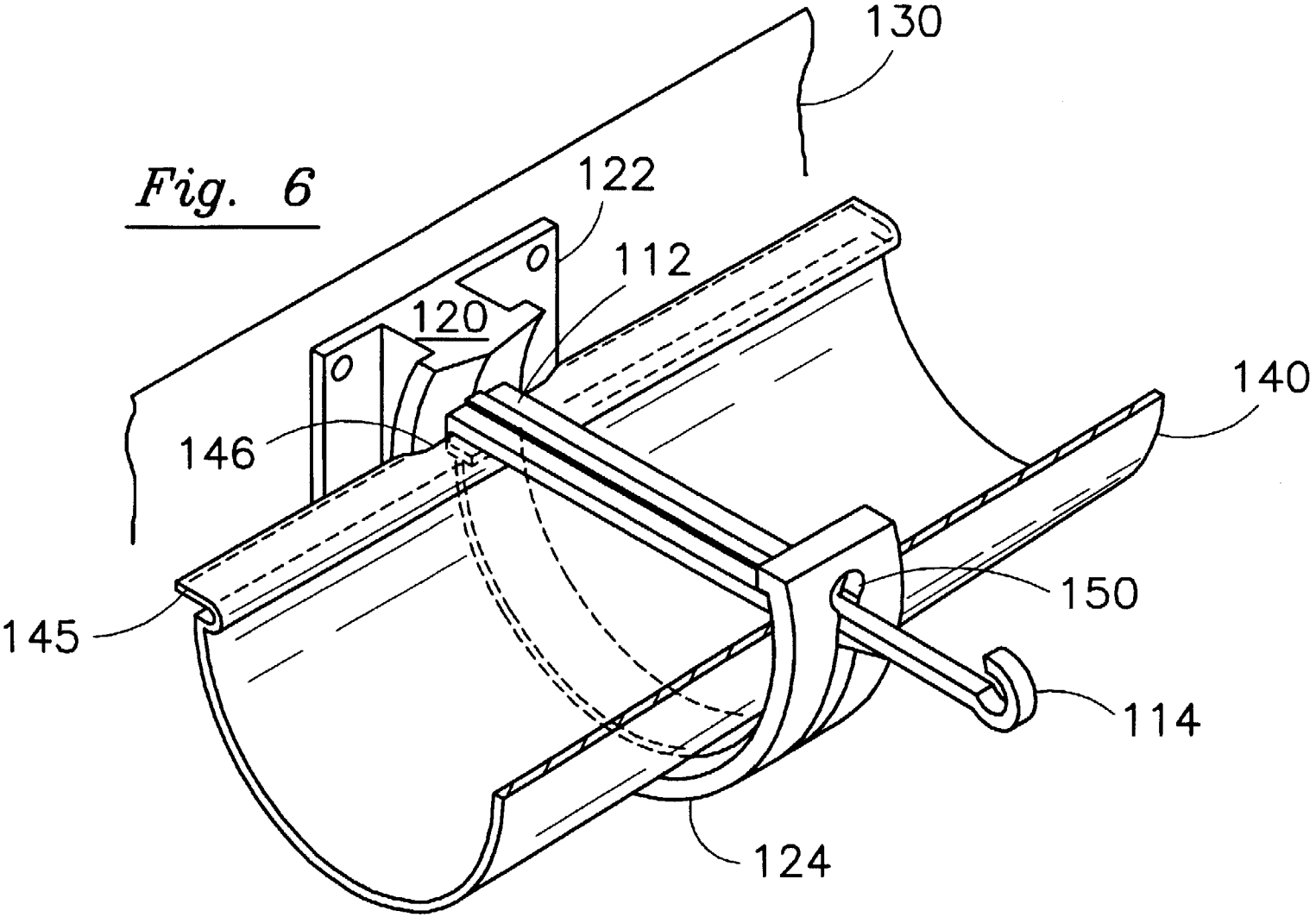
FIG. 6 is a perspective view of the second embodiment of the gutter tilt actuator in a mounting bracket, wherein the gutter is in the water collecting position.

FIG. 6 is a perspective view of the gutter tilt actuator 110 in the mounting bracket 120, which is preferably attached under a roof of a building structure 130 using anchors, nails, screws, etc. (not shown). The mounting bracket includes a structure attaching portion 122 and a cantilevered support 124. The mounting bracket 120 receives a gutter 140 having an open channel between the edges. One of the edges of the gutter 140 is configured with a projecting lip 145 on the side of the gutter intended to be mounted adjacent the structure 130 to facilitate water collection and inhibit the collection of debris between the gutter and the structure 130. The projecting lip 145 is preferably beveled for a selected distance, approximately 1–4 inches, on either side of an intended initial location of the gutter tilt actuator 110 so that the gutter tilt actuator 110 can be received in the cantilevered support 124 without pushing the projecting lip 145 away from the structure 130. The gutter tilt actuator 110 preferably is slid along the outside of the gutter 140, and inserted in the slot of the cantilevered support 124. The gutter engaging portion 112 selectively grips the gutter 140 for rotational displacement. The gutter tilt actuator 110 may also be first inserted in the mounting bracket 120 and the gutter 140 then slid through the gutter engaging portion 112 of the gutter tilt actuator 110. Although the beveled indentation 146 in the gutter lip 145 is desirable to maintain the lip 145 substantially flush with the structure, the tilt actuator 110 is capable of sliding onto the unbeveled portion of the gutter lip 145 to avoid damage to the mounted bracket 120.

The gutter tilt actuator 110, mounting bracket 120 and gutter 140 are preferably manufactured from PVC plastic, nylon or any other weather resistant material. Further, it is preferable that a gutter tilt actuator 110 and a mounting bracket 120 be installed for approximately every ten feet of gutter 140.

Figure 7:
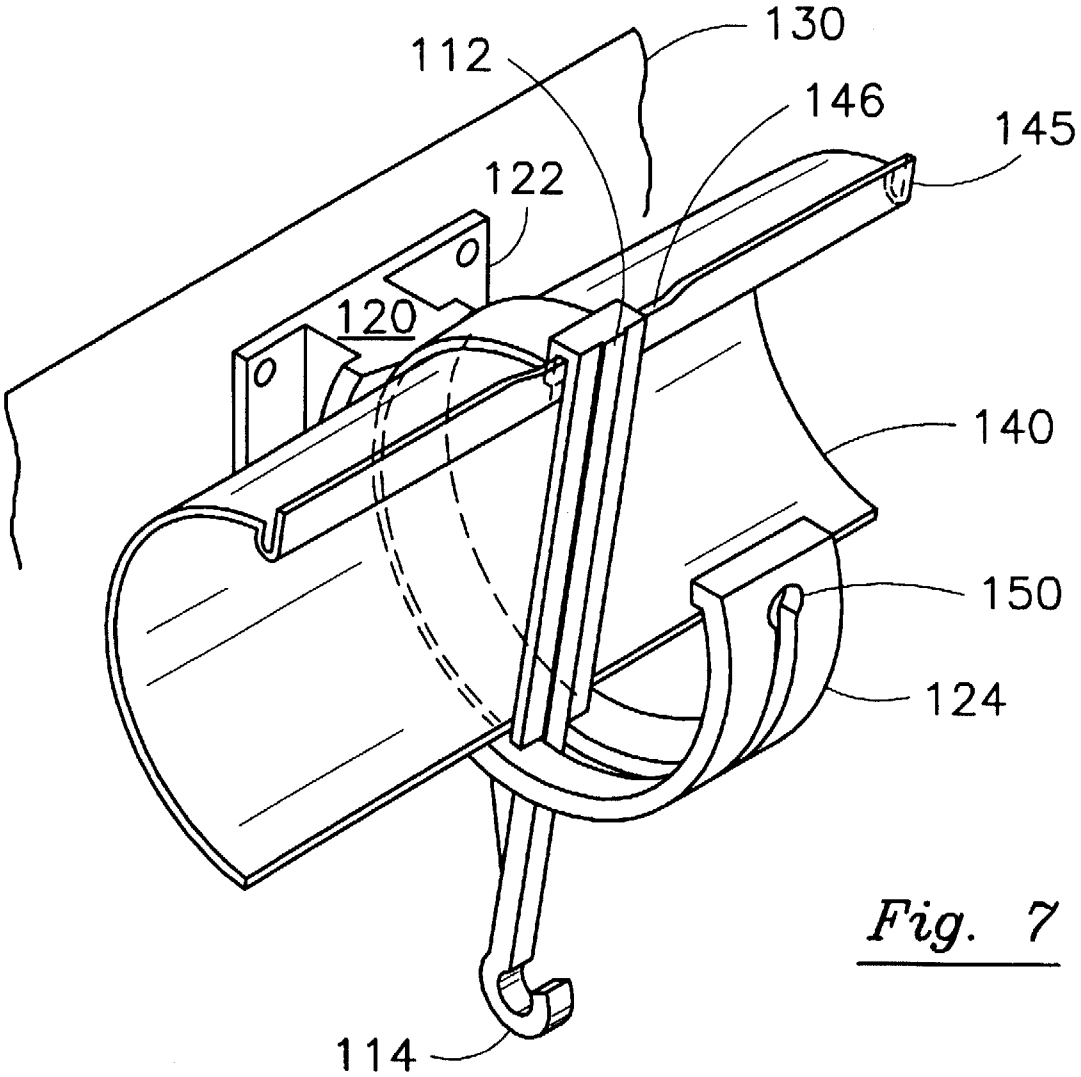
FIG. 7 is a perspective view of the second embodiment of the gutter tilt actuator in the mounting bracket, wherein the gutter is in the cleaning position.

An operator standing on the ground connects a hook (not shown) to the gutter tilt actuator lever 114 of the gutter tilt actuator 110. Normally, the gutter 140 is in a first position or water collecting position (FIG. 6). When the operator wishes to clean the gutter 140, the operator standing on the ground connects a hook on a pole (not shown) to the gutter tilt actuator lever 114 of the gutter tilt actuator 110, and rotates the gutter 140 to the second position or cleaning position (FIG. 7). After the gutter 140 is cleaned, the operator uses the hook to rotate the gutter 140 into a water collecting position and preferably locks the gutter tilt actuator lever 114 of the gutter tilt actuator 110 in a securing slot 150 of the cantilevered support 120. There may be a second securing slot (not shown) in the cantilevered support 120 so that the gutter tilt actuator 110 may be locked into the cleaning position. Although the gutter tilt actuator lever 114 of the gutter tilt actuator 110 is locked and therefore prevents the gutter 140 from rotating, the gutter 140 freely expands and contracts in a longitudinal direction as temperature changes.

Although the invention has been described by making detailed reference to certain specific embodiments, such detail is intended to be instructive rather than restrictive. It will be appreciated by those skilled in the art that many variations may be made in a structure and mode of operation without departing from the spirit and scope of the invention as disclosed in the teachings herein.

I claim:

1. A gutter system comprising:

a gutter configured as an open channel;

a selectively configured gutter tilt actuator for displacing the gutter between a collecting position and a cleaning position operatively associated with said gutter;

said gutter tilt actuator having a gutter engaging portion, and an actuator lever projecting from said gutter engaging portion;

said gutter engaging portion surrounding and selectively gripping said gutter such that said gutter engaging portion grips said gutter for rotational displacement, but permits longitudinal displacement of said gutter with respect to said gutter tilt actuator.

2. A gutter system according to claim 1 wherein the gutter has a substantially uniformly shaped cross section, a bottom and sides, each side terminating in an upper edge which defines an opening to said channel there between and said bottom and sides of said gutter having an exterior surface, and wherein the gutter engaging portion is configured to complement the shape of said exterior surface.

3. A gutter system according to claim 1 further comprising a gutter mounting bracket including:

a structure attaching portion for attachment to a structure with which the gutter system is to be used; and a cantilevered support projecting from said structure attaching portion for supporting said gutter, wherein:

said cantilevered support is configured to complement and receive said gutter tilt actuator for rotational displacement; and said cantilevered support includes a selectively configured slot through which said gutter tilt actuator lever projects whereby said slot defines the limits of rotational displacement of said gutter tilt actuator and, accordingly, the gutter is gripped by said gutter tilt actuator between said cleaning and collecting position, and whereby the disposition of the gutter tilt actuator lever through said slot maintains the longitudinal position of said gutter tilt actuator with respect to said mounting bracket without preventing longitudinal displacement of said gutter relative to said gutter tilt actuator and mounting bracket.

4. A gutter system according to claim 3 wherein said selectively configured slot includes a securing slot engaging and gripping the gutter tilt actuator lever to hold the gutter in a cleaning position without preventing longitudinal displacement of said gutter relative to said gutter tilt actuator and mounting bracket.

5. A gutter system according to claim 3 wherein said selectively configured slot includes a securing slot engaging and gripping the gutter tilt actuator lever to hold the gutter in a collecting position without preventing longitudinal displacement of said gutter relative to said gutter tilt actuator and mounting bracket.

6. A gutter system according to claim 3 further comprising a plurality of said gutter tilt actuators associated with said gutter and said mounting bracket associated with each of said gutter tilt actuators.

7. A gutter system according to claim 6 wherein there is one gutter tilt actuator and associated mounting bracket for approximately every ten feet of gutter.

8. A gutter system according to claim 1 wherein said gutter engaging portion encircles said gutter.

9. A gutter system according to claim 1 wherein one of said edges of said gutter is configured with a projecting lip for directing water into the open channel of the gutter and inhibiting the collection of debris between the gutter and a structure on which it is mounted.

10. A gutter system according to claim 9 further comprising a gutter mounting bracket including:

a structure attaching portion for attachment to a structure with which the gutter system is to be used; and a cantilevered support projecting from said structure attaching portion for supporting said gutter, wherein:

said cantilevered support is configured to complement and receive said gutter tilt actuator for rotational displacement; and said cantilevered support includes a selectively configured slot through which said gutter tilt actuator lever projects whereby said slot defines the limits of rotational displacement of said gutter tilt actuator and, accordingly, the gutter is gripped by said gutter tilt actuator between said cleaning and collecting position, and whereby the disposition of the gutter tilt actuator lever through said slot maintains the longitudinal position of said gutter tilt actuator with respect to said mounting bracket without preventing longitudinal displacement of said gutter relative to said gutter tilt actuator and mounting bracket.

11. A gutter system according to claim 10 wherein said selectively configured slot includes a securing slot engaging and gripping the gutter tilt actuator lever to hold the gutter in a cleaning position without preventing longitudinal displacement of said gutter relative to said gutter tilt actuator and mounting bracket.

12. A gutter system according to claim 10 wherein said selectively configured slot includes a securing slot engaging and gripping the gutter tilt actuator lever to hold the gutter in a collecting position without preventing longitudinal displacement of said gutter relative to said gutter tilt actuator and mounting bracket.

13. A gutter system according to claim 10 further comprising a plurality of said gutter tilt actuators associated with said gutter and said mounting bracket associated with each of said gutter tilt actuators.

14. A gutter system according to claim 13 wherein there is one gutter tilt actuator and associated mounting bracket for approximately every ten feet of gutter.

15. A gutter system according to claim 9 wherein the gutter engaging portion has a lip receiving portion for receiving the projecting lip of said gutter.

16. A gutter system according to claim 15 wherein said projecting lip is beveled where the lip receiving portion engages the projecting lip.

17. A gutter system according to claim 9 wherein the gutter engaging portion encircles said gutter.

18. A gutter mounting bracket and gutter tilt actuator for rotating a gutter configured as an open channel having a bottom and sides, each side terminating in an upper edge which defines an opening in the channel there between wherein said bottom and sides of said gutter have an exterior surface which has a substantially uniformly shaped cross section, said gutter tilt actuator comprising:

a gutter engaging portion having a horizontal elongated section bridging a concave section;

a gutter tilt actuator lever projecting from said gutter engaging portion; and said gutter engaging portion configured to selectively grip said gutter such that said gutter engaging portion grips said gutter for rotational displacement between a collecting position and a cleaning position, but remains longitudinally displaceable with respect to said gutter, and said gutter mounting bracket comprising:

a structure attaching portion for attachment to a structure; and a cantilevered support projecting from said structure attaching portion for supporting said gutter, wherein: said cantilevered support is configured to complement and receive said gutter tilt actuator for rotational displacement, and said cantilevered support includes a selectively configured slot through which said gutter tilt actuator lever projects.

19. A gutter tilt actuator according to claim 18 wherein the gutter engaging portion is configured to complement the shape of said exterior surface.

20. A gutter tilt actuator according to claim 18 configured to encircle said gutter.

* * * * *